US008584601B1

(12) United States Patent
Deschner

(10) Patent No.: US 8,584,601 B1
(45) Date of Patent: Nov. 19, 2013

(54) COLLAPSIBLE WORK BENCH APPARATUS

(71) Applicant: Bernard Deschner, Calgary (CA)

(72) Inventor: Bernard Deschner, Calgary (CA)

(73) Assignee: Wal-Ez Ltd., Calgary, Alberta (CA)

( * ) Notice: Subject to any disclaimer, the term of this patent is extended or adjusted under 35 U.S.C. 154(b) by 0 days.

(21) Appl. No.: 13/655,108

(22) Filed: Oct. 18, 2012

(51) Int. Cl.
*A47B 3/00* (2006.01)

(52) U.S. Cl.
USPC ..... 108/135; 108/134; 108/152; 211/90.02

(58) Field of Classification Search
USPC ..... 108/134–135, 152, 42, 48, 99, 162, 108/179, 108, 147.11, 147.16–147.17, 108/144.11, 109, 107, 110; 211/90.01, 211/90.02, 103, 96, 150
See application file for complete search history.

(56) References Cited

U.S. PATENT DOCUMENTS 1,554,137 A * 9/1925 Slifkin ..... 108/6
1,944,649 A * 1/1934 Smith, Sr. ..... 211/37
2,906,486 A * 9/1959 Bellon et al. ..... 248/242
2,919,034 A * 12/1959 Levy ..... 108/1
3,209,709 A * 10/1965 Shoffner ..... 108/27
3,485,382 A * 12/1969 Larson ..... 211/150
3,742,868 A * 7/1973 Garceau et al. ..... 108/39
3,965,588 A * 6/1976 Long ..... 38/103
4,360,181 A * 11/1982 Burkholder ..... 248/248
4,444,323 A * 4/1984 Travis ..... 211/193
4,492,169 A * 1/1985 Ware et al. ..... 108/6
4,605,131 A * 8/1986 Debus et al. ..... 211/90.02
4,791,873 A * 12/1988 Towfigh ..... 108/10
4,805,863 A * 2/1989 Armstrong et al. ..... 248/243
5,040,468 A * 8/1991 Miller et al. ..... 108/47
5,072,839 A * 12/1991 Arnone ..... 211/187
5,408,936 A * 4/1995 Tseng ..... 108/42
6,026,752 A * 2/2000 Zachrai ..... 108/40
6,135,299 A * 10/2000 Burgess ..... 211/194
6,158,599 A * 12/2000 Lazarus ..... 211/90.01
6,179,136 B1 * 1/2001 Kluge et al. ..... 211/90.01
6,205,934 B1 * 3/2001 Felton et al. ..... 108/107
6,584,916 B1 * 7/2003 Felton et al. ..... 108/107
6,604,473 B2 * 8/2003 Felsenthal ..... 108/107
7,651,065 B2 * 1/2010 Sloan ..... 248/339
7,708,156 B2 * 5/2010 Johnson ..... 211/106
8,333,158 B2 * 12/2012 Wise ..... 108/134
2004/0222178 A1 * 11/2004 Sparkowski ..... 211/187
2005/0204966 A1 * 9/2005 Bienick et al. ..... 108/108

* cited by examiner

*Primary Examiner* — Hanh V Tran
(74) *Attorney, Agent, or Firm* — D. Doak Horne; Gowling Lafleur Henderson LLP

(57) ABSTRACT

A work bench, mountable on a pair of vertical elongate members, adapted to be mounted on a wall. The work bench can be collapsed from an extended position to a stowed position coplanar with the elongate members. The elongate members each have longitudinally spaced notches. A bracing member is provided with a pair of trunnion members that extend from the bracing member and are releasably pivotably coupled to a pair of notches in respective of the pair of elongate members; the bracing member further having a distal end for releasably engaging the working surface of the work bench. When in the extended position, the distal end of the bracing member releasably engages the work bench to support the work bench; when in the collapsed position the work bench overlays the bracing assembly.

16 Claims, 8 Drawing Sheets

COLLAPSIBLE WORK BENCH APPARATUS

FIELD

This invention relates generally to an apparatus with a collapsible work bench mountable to a wall or other generally vertical surface.

BACKGROUND

There are many work areas where space is constrained, such as the interiors of commercial vans, garages, greenhouses, storage lockers, mechanical rooms, etc. In particular, it is difficult to set up conventional work benches in such work areas; when conventional work benches are installed in these areas, it becomes difficult to find space to perform other work in the remaining space. Therefore, having a work bench and/or shelving that can be easily collapsed or removed when not in use would be particularly useful in such constrained spaces. Having such work benches be able to safely support a significant amount of weight and be height adjustable would also be useful.

SUMMARY

According to one aspect of the invention, there is provided an apparatus for mounting to a vertical surface and which comprises a frame, and a work bench and bracing assembly which are collapsible into a compact position against the frame. The frame has at least two longitudinally-extending and transversely-spaced longitudinal members; each longitudinal member comprises a plurality of longitudinally spaced notches extending inwardly from a front edge of the longitudinal member. At least some of the notches of each longitudinal member are vertically aligned with at least some of the notches of the other longitudinal member when the frame is vertically positioned. The work bench has a working surface, side edges extending from the working surface that can each comprise at least one indent, and a pair of trunnion members extending from the side edges. These trunnion members are releasably pivotably coupled to a first pair of aligned notches. The bracing assembly has at least one bracing member and a pair of trunnion members extending from the bracing member that are releasably pivotably coupled to a second pair or notches below the first pair of notches. The bracing member also comprises a distal end for releasably engaging the work bench. The bracing assembly and work bench are each positionable relative to the frame in extended and collapsed positions. When the work bench and bracing assembly are in their extended positions, the distal end of the bracing member releasably engages the work bench such that the bracing assembly supports the work bench. When the work bench and bracing assembly are in their collapsed positions, the work bench overlays the bracing assembly; when the side edges of the work bench includes indents, these indents receive the trunnion members of the bracing assembly such that the work bench and bracing assembly can be positioned generally co-planar with the frame.

The bracing member can be positioned at an angle relative to the frame when the bracing assembly is in the extended position, in which case the distal end of the bracing member is tapered at a taper angle that corresponds to the angle of the bracing member, such that the distal end makes flush contact with the work bench when engaged therewith. The work bench can comprise a front lip that extends downwardly from the working surface and is positioned to abut the distal end of the bracing member when the bracing assembly is engaged with the working bench. The work bench can also comprise a plurality of indents along each side edge; these plurality of indents are spaced from each other at a spacing corresponding to the spacing between notches in the frame.

The bracing assembly can have a thickness that is less than or equal to a depth of the frame; the bracing assembly trunnion members in such case are coupled to the second pair of notches such that the bracing assembly is located entirely within the depth of the frame when in the collapsed position. In particular, the work bench trunnion members can be coupled to the first pair of notches such that the working surface is flush with or within the depth of the frame when the work bench is in the collapsed position.

The apparatus can further comprise a shelf having a working surface, trunnion members coupled to the working surface and releasably coupled to a third pair of aligned notches, and at least one shelf brace coupled to the frame and the shelf. The shelf can be positioned relative to the frame in an extended position and a collapsed position.

At least one notch can have an L-shape comprising a rearwardly-extending portion and downwardly-extending portion, in which case the trunnion members of the work bench and bracing assembly are pivotably seated in the downwardly-extending portion. Alternatively, at least one notch can be straight and extend at a rearwards and downwards angle into the longitudinal member. In another alternative, at least one notch can be curved and extend rearwardly and downwardly into the longitudinal member.

According to another aspect of the invention, there is provided a kit for an apparatus mountable to a vertical surface and having a frame with a work bench and bracing assembly that are collapsible into a compact position relative to the frame. The frame has at least two longitudinally-extending and transversely-spaced longitudinal members; each longitudinal member comprises a plurality of longitudinally spaced notches that extend inwardly from a front edge of the longitudinal member. At least some of the notches of each longitudinal member are vertically aligned with at least some of the notches of the other longitudinal member when the frame is vertically positioned. The work bench has a working surface, side edges extending from the working surface and a pair of trunnion members extending from the side edges or working surface that are for releasably pivotably coupling to a first pair of aligned notches of the frame. The bracing assembly has at least one bracing member and a pair of trunnion members extending from the bracing member that are for releasably pivotably coupling to a second pair or notches of the frame below the first pair of notches. The bracing member comprises a distal end for releasably engaging the work bench. When the bracing assembly, work bench and frame are assembled, the bracing assembly and work bench are each positionable relative to the frame in extended and collapsed positions. When the work bench and bracing assembly are in their extended positions, the distal end of the bracing member releasably engages the work bench such that the bracing assembly supports the work bench. When the work bench and bracing assembly are in their collapsed positions the work bench overlays the bracing assembly such that the work bench and bracing assembly are generally co-planar with the longitudinal members.

Each side edge can further comprise at least one indent; when the work bench and bracing assembly are in their collapsed positions, the work bench overlays the bracing assembly such that the indents of the work bench receive the trunnion members of the bracing assembly such that the work bench and bracing assembly are generally co-planar with the frame.

DETAILED DESCRIPTION

Figure 1:
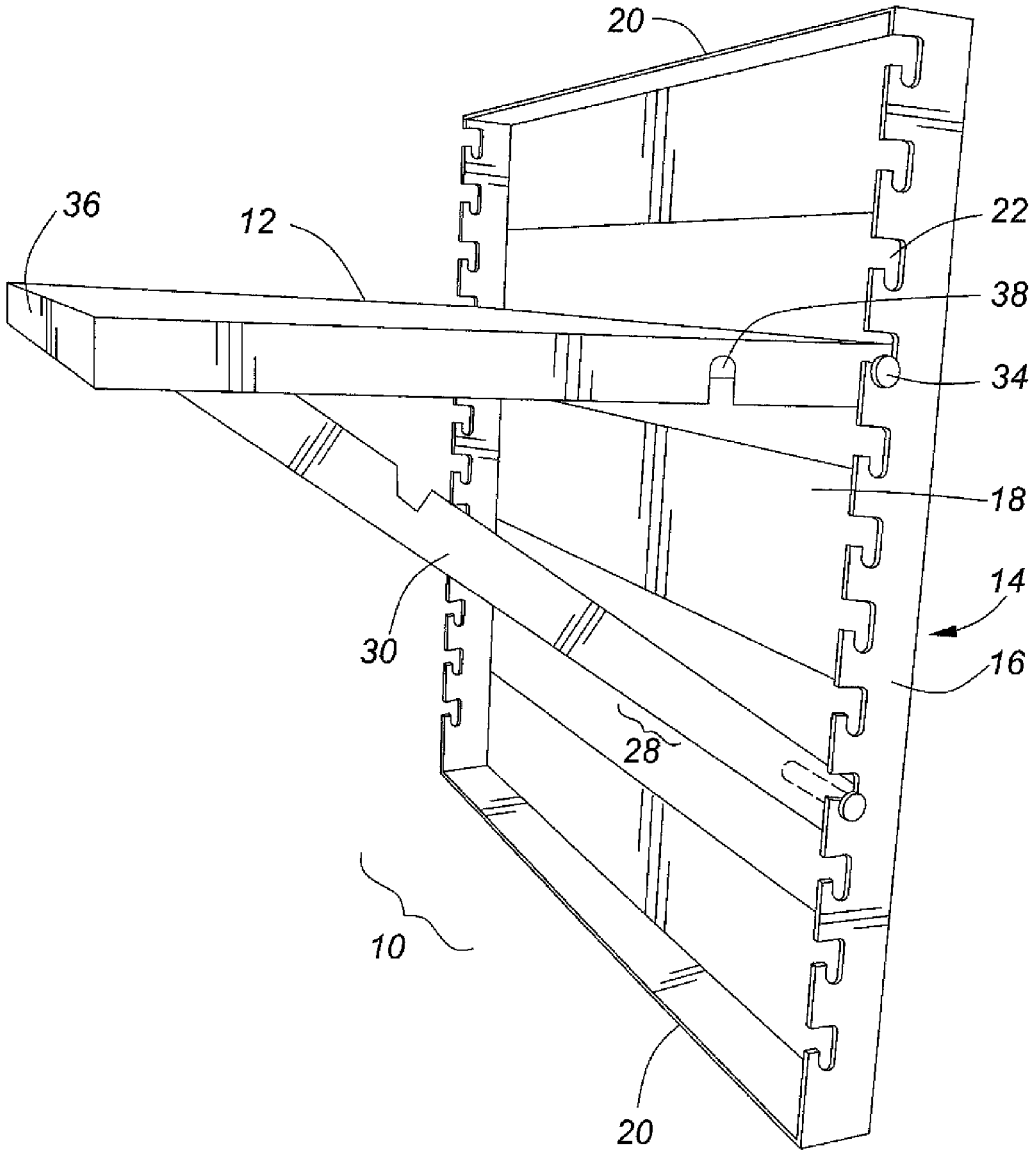
FIG. 1 is a right perspective view of an apparatus with a collapsible work bench according to one embodiment, wherein the work bench is shown in an extended position.
Figure 2:
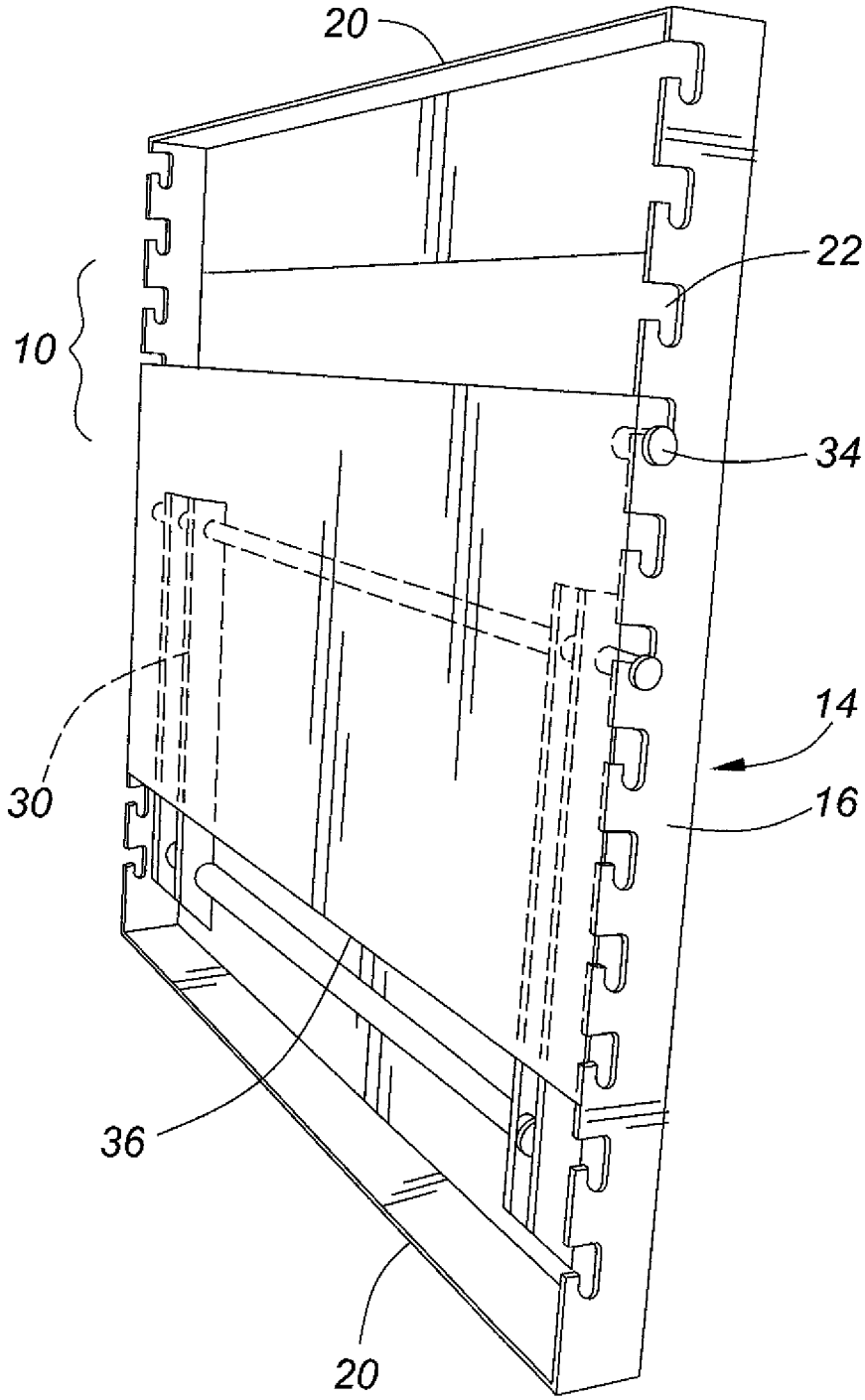
FIG. 2 is a right perspective view of the apparatus with the work bench shown in a collapsed position.

Referring to FIGS. 1 to 5 and according to one embodiment, an apparatus 10 is provided with a collapsible work bench 12 which can be positioned in an extended position as shown in FIG. 1 and in a collapsed position as shown in FIG. 2. While this embodiment features one work bench 12, the apparatus 10 can optionally be provided with a different number of work benches (not shown). The apparatus 10 comprises a frame 14 which is intended for mounting to a generally vertical surface such as a wall or the panel of a van. Although not shown, mounting brackets or other suitable mounting means can be provided to mount the frame 14 to the vertical surface. The mounting brackets can be welded or similarly secured to the frame 14, and have openings for screws or other fastening means to connect the brackets to the vertical surface.

Directional terms such as "back", "front", "vertical", "horizontal", "above" and "below" will hereinafter be used in context of the apparatus 10 when mounted to a vertical surface as shown in the Figures. Such directional terms are used merely to assist the reader in understanding the structure of components and their interrelationships in the apparatus 10 and are not intended, unless expressly stated, to suggest any limitations on how the apparatus 10 is to positioned during use or relative to another object.

The frame 14 comprises a pair of parallel and spaced longitudinal members 16 that in operation would be mounted in a generally vertical orientation. The frame 14 also comprises a number of transverse members which connect the longitudinal members 16 together, namely: back members 18, and top and bottom members 20. All the longitudinal and transverse members 16, 18, 20 can be welded, bolted or otherwise fixedly secured together to form a relatively rigid frame structure. All of the members 16, 18, 20 can be made of metal or another material that provide comparable mechanical properties. A row of mounting holes (not shown) are provided on the back members 18 to enable the frame 14 to be affixed to a wall or other vertical surface.

Figure 8:
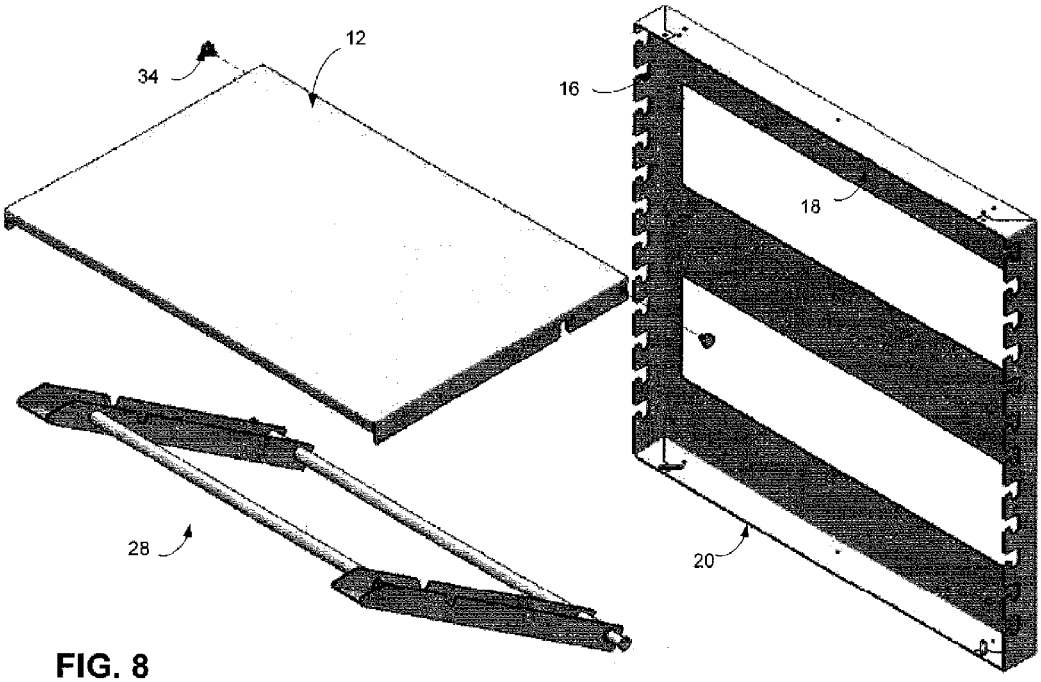
FIG. 8 is a perspective view of a kit for a collapsible work bench apparatus, comprising a frame, work bench and bracing assembly according to another embodiment.

Referring to FIG. 8, the frame 14 can alternatively be formed from a single sheet of material ("back pan"), in which case one or more of the edges of the sheet are bent 90 degree to form one or more of the longitudinal members 16, and top and bottom members 20; these members 16, 20 can be fastened together with techniques known in the art. Rectangular openings can be cut out of the sheet to save weight and provide material to form other components of the apparatus 10; the remaining sheet material serves as the transverse members 18. This approach is a particularly useful to provide a relatively rigid structure as well as avoiding the need to carefully align and assemble each component of the frame 14 together. In an alternative embodiment, the back pan does not feature cut-outs, and instead of separate back members 18 there is a single sheet of material connecting the longitudinal and top and bottom members 16, 20 together.

Each longitudinal member 16 features a plurality of front-facing notches 22 that are generally evenly spaced along the length of the longitudinal member 16. Each notch 22 extends rearwardly then downwardly (when the longitudinal members 16 are vertically mounted) and resembles an "L" shape. Each notch 22 for each longitudinal member 16 is positionally aligned with a corresponding notch 22 in the other longitudinal member 16 such that the two corresponding notches 22 are at the same height when the longitudinal members 16 are vertically mounted. Alternatively but not shown, each notch 22 can be generally straight and extend at an inwards and downwards angle into the longitudinal member 16. In yet another alternative that is not shown, each notch 22 can be curved and extend inwardly and downwardly into the longitudinal member 16.

The apparatus 10 also comprises a bracing assembly 28 comprising a pair of longitudinally-extending and transversely-spaced bracing members 30 that are connected by a pair of transversely-extending connecting members 32 such that the bracing members 30 are spaced apart and generally parallel to each other. While the illustrated embodiment shows a bracing assembly 28 with two bracing members 30, the bracing assembly 28 can alternatively feature a different number of bracing members, such as one or three (not shown). The bracing members 30 in the present embodiment each comprise a U-shaped flange and the connecting members 32 each comprise a cylindrical bar of differing length; the flange may be made of metal or another suitable material. The connecting member 32 of shorter length ("short connecting member") extends between the bracing members 30 near a distal end thereof. In contrast, the connecting member 32 of longer length ("long connecting member") extends between the bracing members 32 near a proximal end thereof, and extends through the side walls of each bracing member 30 such that portions of the bar 32 protrude from the outside side wall of each bracing member 30. The length of this long connecting member 32 is sufficient that the protruding portions ("trunnion members") can releasably engage a pair of aligned notches 22 of the longitudinal members 16 and the diameter of the trunnion members is selected to allow the trunnion members to pivot within the notches 22 with minimal or no play, thereby establishing a pivotable coupling between the bracing assembly 28 and the frame 12. The L-shape of the notches 22 allow the trunnion members to be lifted upwards then outwards from the frame 14, thereby establishing a releasable coupling between the bracing assembly 28 and the frame 12.

Similarly, the work bench 12 comprises a pair of trunnion members 34 protruding outwardly from side edges 35 of the work bench 12, which can engage a pair of aligned notches 22. Like the trunnion members of the bracing assembly 28, the trunnion members 34 of the work bench 12 can be cylindrical and have a diameter that allows the trunnion members 34 to be pivotably and releasably coupled to the notches 22.

The work bench 12 further comprises a generally planar working surface, and the pair of side edges 35 extend downwardly from the sides of the working surface when the work bench 12 is in a horizontal position. Conveniently, a single sheet of metal or another suitable material can be used to form the working surface and the side edges, wherein the side edges are bent into place. At a front edge of the work bench 12 is a lip 36 which spans the width of the front of the work bench 12. Like the side edges 35, the lip 36 extends downwardly from the working surface when the working surface is in the horizontal position.

Alternatively, the work bench 12 can be provided without side edges, in which case the trunnion members are coupled directly to the working surface.

Figure 3:
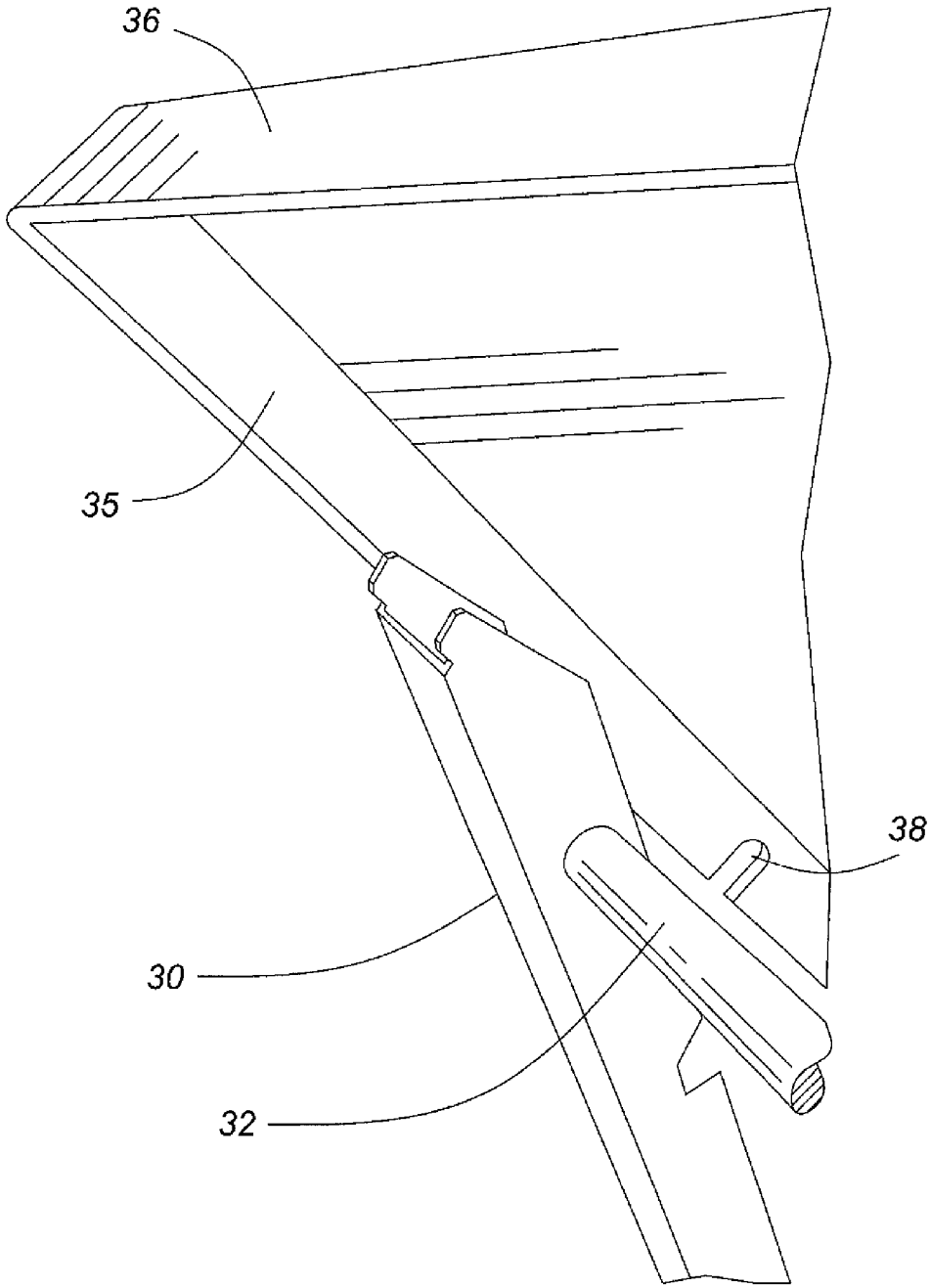
FIG. 3 is a detail perspective view of a part of the work bench and an engagement end of a bracing assembly for engaging an underside of the work bench.
Figure 4:
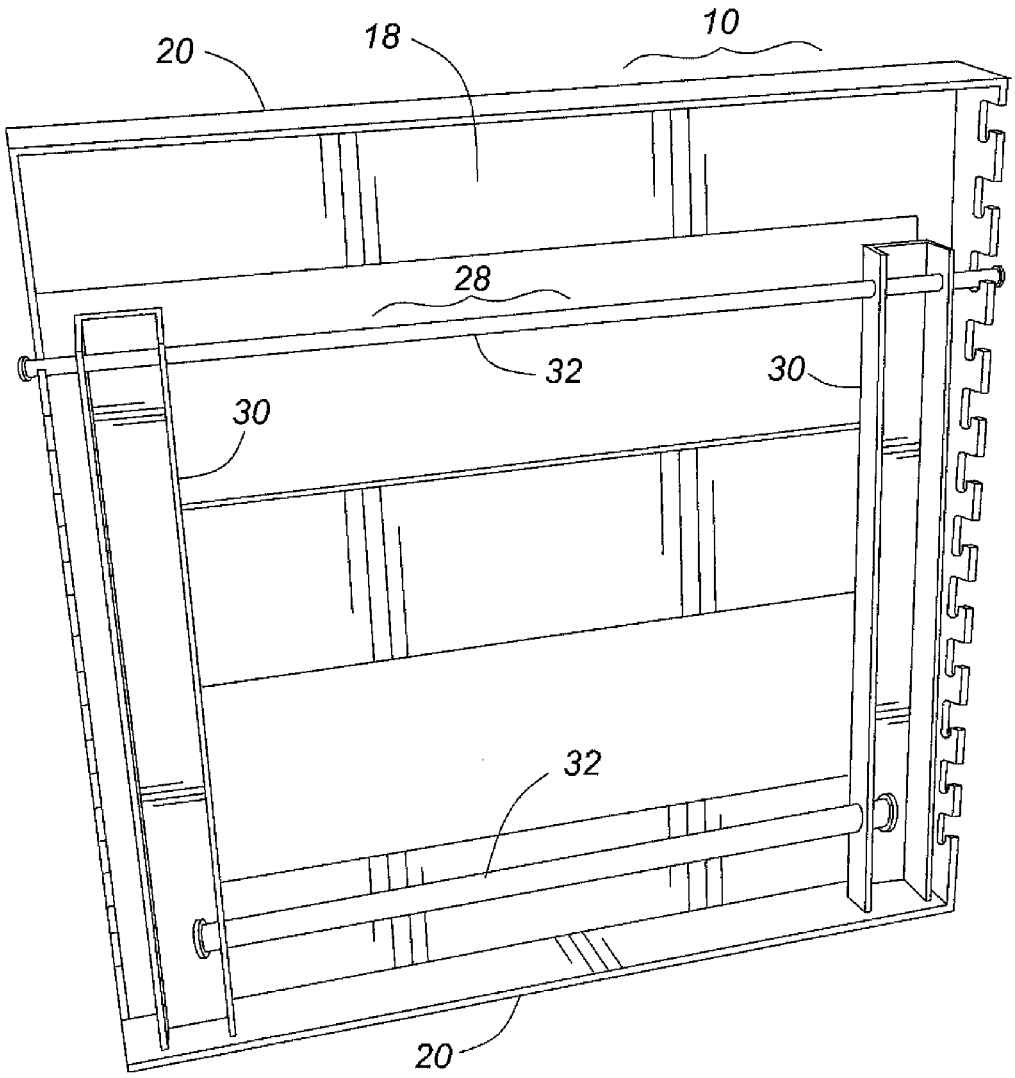
FIG. 4 is front perspective view of the apparatus with the bracing assembly shown in a collapsed position.

When the work bench 12 is positioned horizontally (extended position), it can be fixed in this extended position by the bracing assembly 28. The bracing assembly 28 is mounted to the frame 14 below the work bench 12 (in this embodiment the trunnion members of the bracing assembly 28 are coupled to a pair of notches 22 that are five notches below the pair of notches 22 which engage the trunnion members of the work bench 12), and is positioned to extend outwards and upwards at a bracing angle such that a distal end of the bracing assembly 28 contacts the underside and lip of the work bench 12. As shown in FIG. 3, the distal end of each bracing member 30 is tapered such that there is a relatively flush contact between the distal end of each bracing member 30 and the underside of the work bench 12 when the bracing assembly 28 is in contact with the work bench 12. The taper angle will correspond with the desired bracing angle; in this embodiment the taper angle is selected to allow flush contact of the bracing member 30 with the underside of the work bench 12 when the trunnion members of the bracing assembly 28 and work bench 12 are separated by five notches.

The lip 36 serves as an abutment for the tapered distal ends of the bracing members 30 and prevents the bracing members 30 from sliding and separating from the work bench 12. The work bench 12 can thus be disengaged from the bracing assembly 28 by lifting the work bench 12 such that the lip clears the distal ends of the bracing members 30.

Once disengaged, the bracing assembly 28 can be pivoted from its bracing position downwards into a collapsed position wherein the bracing assembly 28 hangs vertically from the frame 14; the thickness of the bracing assembly 28 members are selected so that the bracing assembly 28 does not protrude from the frame 14 when in the collapsed position. This allows the work bench 12 to be pivoted from its extended position and downwards into a collapsed position such that at least part of the work bench flatly overlays the collapsed bracing assembly 28. When the work bench 12 and bracing assembly 28 are collapsed in such a manner, the apparatus 10 can provide a very compact and slim profile. Securing means (not shown) such as thumb screws can be provided to secure the bracing assembly 28 and work surface in the collapsed position against the frame 14.

As can be seen in the Figures, this embodiment of the apparatus 10 features a relatively short frame 12, which is too short to allow the bracing assembly 28 to pivot from its bracing position into a collapsed position that fits entirely within the frame 14. In cases where it is necessary for the bracing assembly 28 to fit entirely within the frame 14 when collapsed (e.g. when the frame is mounted close to or on the floor), the frame 14 can be designed with a sufficient length to allow the bracing assembly 28 to pivot into a collapsed position entirely within the frame 14 regardless of which pair of notches 22 it is coupled to. Alternatively, the frame 14 can be designed with a sufficient length to allow the bracing assembly 28 to be mounted entirely within the frame in a collapsed position only when the bracing assembly 28 is coupled to certain pairs of notches 22; if the bracing assembly 28 is coupled to a pair of notches 22 that are too low to allow the bracing assembly 28 to pivot into a collapsed position that is entirely within the frame 14 (such as shown in FIGS. 1 and 2), the bracing assembly 28 must be first decoupled from the frame 14 then coupled to a different pair of notches 22 that are sufficiently high to allow the bracing assembly 28 to fit entirely within the frame 14, or at least high enough to allow the bracing assembly 28 to clear the floor when in the collapsed position.

Each side edge of the work bench 12 is provided with a cut-out or indent 38 which is large enough to receive the trunnion members of the bracing assembly 28. This enables the work bench 12 to be overlaid over the bracing assembly 28 when both components 12, 28 are in their collapsed position, such that both the work bench 12 and bracing assembly 28 can be positioned relatively parallel to and co-planar with the frame 14. Without such indents 38, the side edges of the work bench 12 would abut against the bracing assembly 28 and cause the work bench 12 to jut out at an angle from the frame 14. In this embodiment, the indent 38 is positioned such that each joint portion of the bracing assembly 28 fits within one of the indents 38 when the bracing assembly 28 and work bench 12 are mounted to notches 22 that are spaced two notches apart. Alternatively, the indent 38 can be located at a different position along the work bench 12 if it is intended for the bracing assembly 28 and work bench 12 to be mounted to the frame 14 with a different spacing. Alternatively, multiple indents (not shown) can be provided along each side of the work bench 12 to allow a user to mount the bracing assembly 28 and work bench 12 to the frame 14 at different relative positions.

The indents 38 provided in the work bench 12 are large enough that the work bench 12 can be overlaid over the bracing assembly without the trunnion members frictionally contacting the work bench 12. Alternatively, the indents 38 can sized to snugly engage the bracing assembly trunnion members so that there is sufficient frictional engagement to affix the work bench 12 to the bracing assembly 28 when both are in their collapsed position. The degree of frictional engagement should be selected to impede separation of the work bench 12 from the bracing assembly 28 due to a slight force, e.g. forces caused by movement of a van, but not be so great that a user cannot readily separate the work bench 12 from the bracing assembly 28. As noted above, a strap or other securing means can be provided to secure the bracing assembly 28 to the frame; this securing means can also be used to secure the work bench 12 to the frame 14 and/or to the bracing assembly 28.

Instead of the releasable coupling featured in this embodiment which couple the bracing assembly to the work bench, i.e. the distal ends of the bracing assembly 28 contacting the underside of the work bench 12 and abutting against the lip 36, other types of releasable couplings can be provided as would be known to one skilled in the art. For example, a cylindrical rod (not shown) can be affixed to the underside of the work bench 12 and the bracing members 32 can be adapted to releasibly clamp to the rod.

Figure 5:
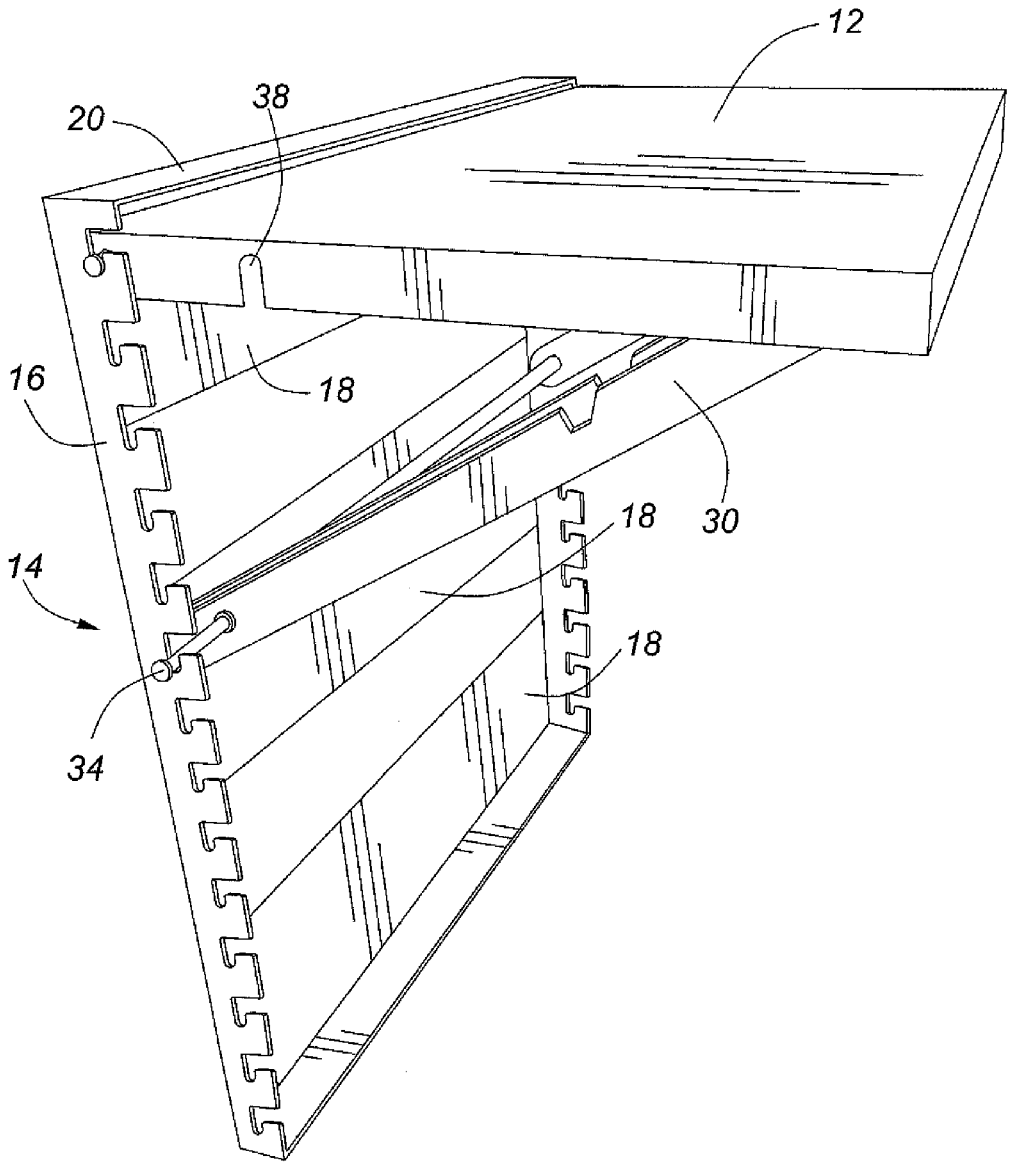
FIG. 5 is a left perspective view of the apparatus with the work bench shown in an extended position.

The plurality of aligned notches 22 enable the work bench 12 and bracing assembly 28 to be mounted at various locations on the frame 14; FIG. 1 shows the work bench 12 mounted at just above the mid-point of the frame 14, wherein FIG. 5 shows the work bench 12 mounted at the top of the frame 14. When the work bench is to be extended, the bracing assembly 28 will be positioned on the frame 14 such that the bracing assembly 28 engages the work bench at the proper bracing angle. When the work bench 12 is to be collapsed, the bracing assembly 28 will be positioned on the frame 14 accordingly such that the indents 38 receive the trunnion members of the bracing assembly 28, thereby allowing the work bench 12 to collapse flat over the bracing assembly 28.

Figure 6:
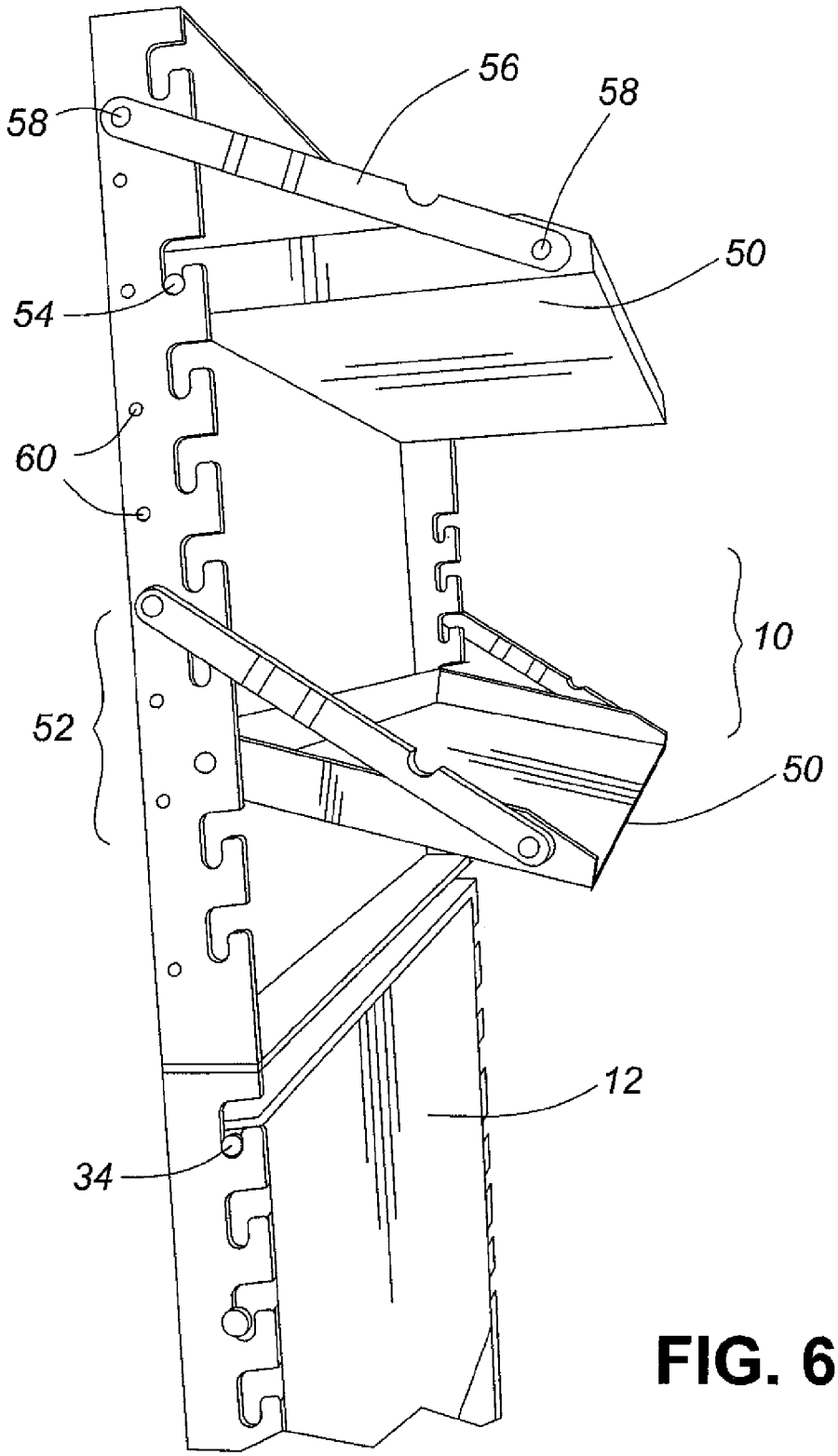
FIG. 6 is a left perspective view of an apparatus with a collapsible work bench and two collapsible shelves according to a second embodiment, with the shelves shown in extended positions.
Figure 7:
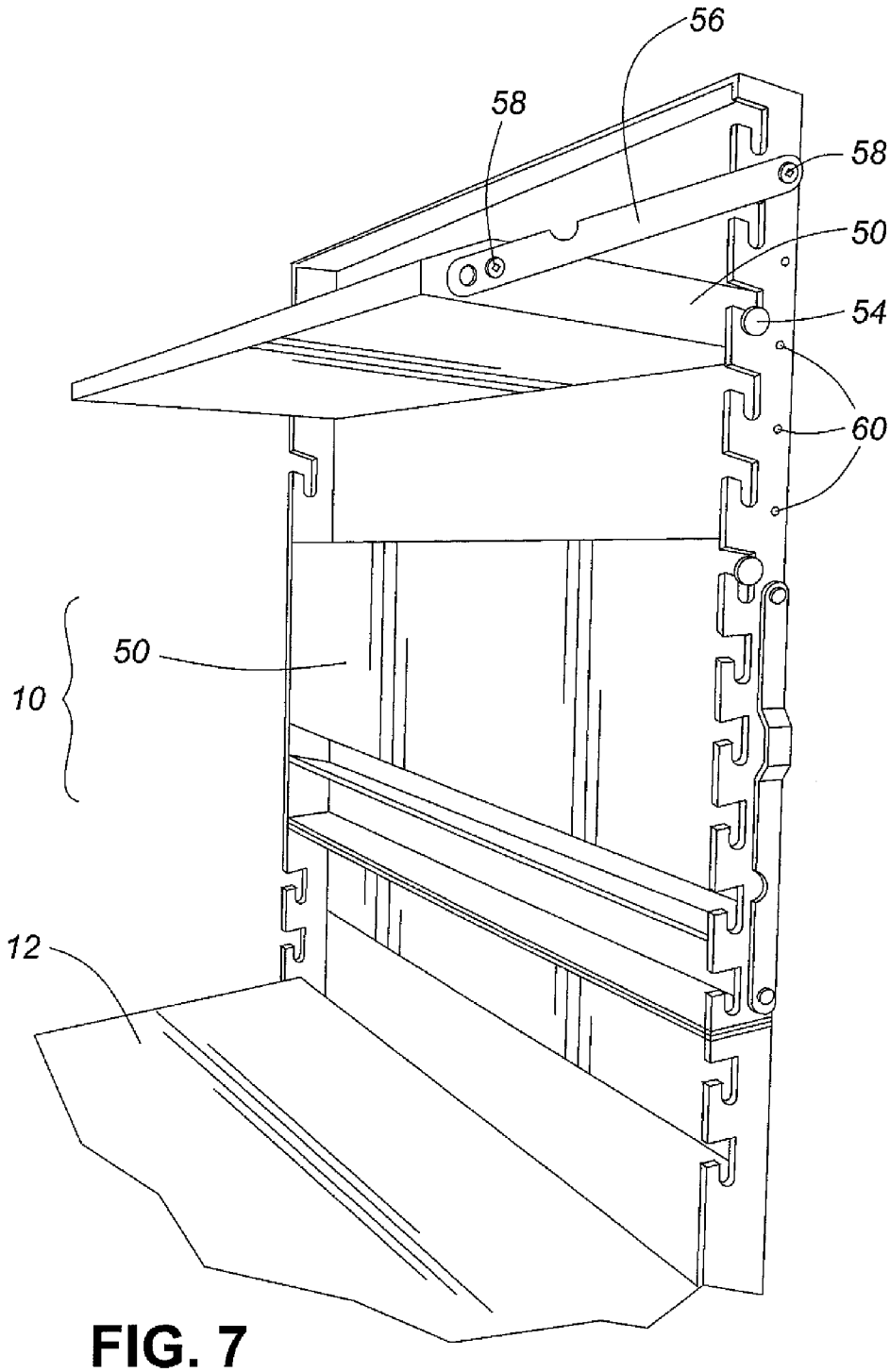
FIG. 7 is a right perspective view of the second embodiment of the apparatus, with one of the shelves shown in an extended position and the other shelf shown in a collapsed position.

Referring now to FIGS. 6 and 7 and according to a second embodiment, the apparatus 10 further comprises a pair of collapsible shelves 50 in additional to the work bench 12. Each shelf 50 is pivotable relative to the frame 14 between an extended position and a collapsed position.

While this embodiment features an apparatus 10 with two shelves 50, the apparatus 10 can in an alternative embodiment be provided with a different number of shelves 50. In another alternative embodiment, the apparatus 10 can be provided with only shelves 50 and no work benches 12.

In this embodiment, the apparatus 10 further comprises a second frame 52 of similar configuration to the first frame 14, which is positioned above the first frame 14 and serves as a mount for the shelves 50; alternatively but not shown, the apparatus 10 comprises only one frame 14 with a longer set of longitudinal members 16 which serve to mount both the shelves 50 and the work bench 12. In yet another alternative embodiment, the apparatus 10 has a single frame 14 of the same dimensions as the first embodiment and which serves as a mount for both the shelves 50 and the work bench 12.

Each shelf 50 comprises a generally planar working surface with a pair of vertically extending side edges, which extend upwards when each shelf 50 is in its horizontal extended position. A cylindrical joint 54 extends transversely outwards from each side edge near the back end of the shelf 40. The joints 54 are positioned to engage a pair of aligned notches 22 such that the shelf 40 is relesasably pivotally coupled to the frame 14.

The apparatus 10 further comprises a pair of shelf braces 56 for each shelf 50 that operate to secure each shelf 50 in its horizontal extended position. Each shelf brace 56 comprises a generally elongated member and a pair of pivotable joints 58 at each end of the elongated member, namely, a proximal joint 58 which is pivotably mounted to an opening in the longitudinal member 16 of the frame 14, and a distal joint 58 which is pivotably mounted to an opening in the side edge of the shelf 50. Both distal and proximal joints 58 can be releasibly coupled to the frame 14 and shelf 50 respectively; this enables the shelf braces 56 to disengage from the shelf 50 such that the shelf 50 can be rotated into its collapsed position.

The apparatus 10 can be provided with a plurality of openings 60 that extend along the length of the longitudinal members 16 of the frame 14 and which can receive the proximal joint 58 of the shelf brace 56; similarly, the joints 54 of each shelf 50 can be coupled to any pair of aligned notches 22 in the longitudinal members 16 such that the shelf 50 and associated shelf braces 56 can be mounted to the frame 14 at differing heights.

Both the shelves 40 and work bench 12 can be moved into a collapsed position which results in the apparatus 10 having a relatively compact form. In particular, the shelves 50 and work bench 12 are each configured to pivot into a collapsed position wherein the shelves 50 and work bench 12 fit entirely within the depth of the frame 14; in other words, the side edges of the shelves 50 and work bench 12 are selected so that the shelves 50 and work bench 12 do not protrude from the frame 14 when in the collapsed position.

According to another embodiment and referring to FIG. 8, the apparatus 10 can be provided as a kit, in which case the frame 14, work bench 12 and bracing assembly can be assembled to form the apparatus 10.

While particular embodiments have been described in the foregoing, it is to be understood that other embodiments are possible and are intended to be included herein. It will be clear to any person skilled in the art that modifications of and adjustments to the foregoing embodiments, not shown, are possible.

What is claimed is:

1. An apparatus for mounting to a vertical surface, comprising:

(a) a frame having at least two longitudinally-extending and transversely-spaced longitudinal members, each longitudinal member comprising a plurality of longitudinally spaced notches extending inwardly from a front edge of the longitudinal member, at least some of the notches of each longitudinal member being vertically aligned with at least some of the notches of the other longitudinal member when the frame is vertically positioned;

(b) a work bench having a working surface, side edges extending from the working surface and a pair of trunnion members extending from the side edges and releasably pivotably coupled to a first pair of aligned notches, and wherein each side edge comprises at least one indent; and (c) a bracing assembly having at least one bracing member and a pair of trunnion members extending from the bracing member and releasably pivotably coupled to a second pair of notches below the first pair of notches, the bracing member comprising a distal end for releasably engaging the work bench;

the bracing assembly and work bench each being positionable relative to the frame in extended and collapsed positions, wherein when the work bench and bracing assembly are in their extended positions the distal end of the bracing member releasably engages the work bench such that the bracing assembly supports the work bench, and when the work bench and bracing assembly are in their collapsed positions, the work bench overlays the bracing assembly, wherein the trunnion members of the bracing assembly engage a pair of said notches such that the indents of the work bench receive the trunnion members of the bracing assembly when the work bench and bracing assembly are generally co-planar with the frame.

2. An apparatus as claimed in claim 1 wherein the bracing member is at an angle relative to the frame when the bracing assembly is in the extended position, and the distal end of the bracing member is tapered at a taper angle that corresponds to the angle of the bracing member such that the distal end makes flush contact with the work bench when engaged therewith.

3. An apparatus as claimed in claim 2 wherein the work bench comprises a front lip extending downwards from the working surface and positioned to abut the distal end of the bracing member when the bracing assembly is engaged with the working bench.

4. An apparatus as claimed in claim 1 wherein the work bench comprises a plurality of indents along each side edge, the plurality of indents being spaced from each other at a spacing corresponding to the spacing between notches in the frame.

5. An apparatus as claimed in claim 1 wherein the bracing assembly has a thickness that is less than or equal to a depth of the frame, and the bracing assembly trunnion members are coupled to the second pair of notches such that the bracing assembly is entirely within the depth of the frame when in the collapsed position.

6. An apparatus as claimed in claim 5 wherein the work bench trunnion members are coupled to the first pair of notches such that the working surface is flush with or within the depth of the frame when the work bench is in the collapsed position.

7. An apparatus as claimed in claim 1 further comprising a shelf comprising a working surface and trunnion members coupled to the working surface and releasably coupled to a third pair of aligned notches, and at least one shelf brace coupled to the frame and the shelf, wherein the shelf is positionable relative to the frame in an extended position and a collapsed position.

8. An apparatus as claimed in claim 1 wherein at least one notch has a L-shape comprising a rearwardly-extending portion and downwardly-extending portion, wherein the trunnion members of the work bench and bracing assembly are pivotably seated in the downwardly-extending portion.

9. An apparatus as claimed in claim 1 wherein at least one notch is straight and extends at a rearwards and downwards angle into the longitudinal member.

10. An apparatus as claimed in claim 1 wherein at least one notch is curved and extends rearwardly and downwardly into the longitudinal member.

11. An apparatus for mounting to a vertical surface, comprising:

(a) a frame having at least two longitudinally-extending and transversely-spaced longitudinal members, each longitudinal member comprising a plurality of longitudinally spaced notches extending inwardly from a front edge of the longitudinal member, at least some of the notches of each longitudinal member being vertically aligned with at least some of the notches of the other longitudinal member when the frame is vertically positioned;

(b) a work bench having a working surface, side edges extending from the working surface and a pair of trunnion members extending from the side edges of the working surface and releasably pivotably coupled to a first pair of aligned notches, and wherein each side edge comprises at least one indent; and (c) a bracing assembly having at least one bracing member and a pair of trunnion members extending from the bracing member and releasably pivotably coupled to a second pair of notches below the first pair of notches, the bracing member comprising a distal end for releasably engaging the work bench;

the bracing assembly and work bench each being positionable relative to the frame in extended and collapsed positions, wherein when the work bench and bracing assembly are in their extended positions the distal end of the bracing member releasably engages the work bench such that the bracing assembly supports the work bench, and when the work bench and bracing assembly are in their collapsed positions, the work bench overlays the bracing assembly, wherein the trunnion members of the bracing assembly engage a pair of said notches such that the indents of the work bench receive the trunnion members of the bracing assembly when the work bench and bracing assembly are generally co-planar with longitudinal members.

12. An apparatus as claimed in claim 11 wherein said bracing assembly comprising a pair of bracing members, each bracing member having a recess, wherein a lower side edge of said working surface engages said recess when said work bench and said bracing assembly are in said collapsed position.

13. An apparatus as claimed in claim 11 wherein when the work bench and bracing assembly are in their collapsed positions, the work bench overlays the bracing assembly such that the indents of the work bench releasibly engage the trunnion members of the bracing assembly such that the work bench and bracing assembly are retained generally co-planar with the frame.

14. A kit for an apparatus mountable to a vertical surface, comprising:

(a) a frame having at least two longitudinally-extending and transversely-spaced longitudinal members, each longitudinal member comprising a plurality of longitudinally spaced notches extending inwardly from a front edge of the longitudinal member, at least some of the notches of each longitudinal member being vertically aligned with at least some of the notches of the other longitudinal member when the frame is vertically positioned;

(b) a work bench having a working surface, side edges extending from the working surface and a pair of trunnion members extending from the side edges of the working surface and for releasably pivotably coupling to a first pair of aligned notches of the frame, and wherein each side edge comprises at least one indent; and (c) a bracing assembly having at least one bracing member and a pair of trunnion members extending from the bracing member and for releasably pivotably coupling to a second pair of notches of the frame below the first pair of notches, the bracing member comprising a distal end for releasably engaging the work bench;

when the bracing assembly, work bench and frame are assembled, the bracing assembly and work bench are each positionable relative to the frame in extended and collapsed positions, wherein when the work bench and bracing assembly are in their extended positions the distal end of the bracing member releasably engages the work bench such that the bracing assembly supports the work bench, and when the work bench and bracing assembly are in their collapsed positions the work bench overlays the bracing assembly, wherein the trunnion members of the bracing assembly engage a pair of said notches such that the indents of the work bench receive the trunnion members of the bracing assembly when the work bench and bracing assembly are generally co-planar with longitudinal members.

15. A kit as claimed in claim 14 wherein said bracing assembly comprising a pair of bracing members, each bracing member having a recess, wherein a lower side edge of said working surface engages said recess when said work bench and said bracing assembly are in said collapsed position.

16. A kit as claimed in claim 14 wherein when the work bench and bracing assembly are in their collapsed positions, the work bench overlays the bracing assembly such that the indents of the work bench releasibly engage the trunnion members of the bracing assembly such that the work bench and bracing assembly are retained generally co-planar with the frame.

* * * * *